US007611551B2

(12) United States Patent
Gaughan et al.

(10) Patent No.: US 7,611,551 B2
(45) Date of Patent: Nov. 3, 2009

(54) METHOD FOR REDUCING THE FREEZING POINT OF AMINATED AVIATION GASOLINE BY THE USE OF TERTIARYAMYLPHENYLAMINE

(75) Inventors: Roger Grant Gaughan, Sewell, NJ (US); Daniel Dawson Lowrey, Westville, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 568 days.

(21) Appl. No.: 11/212,411

(22) Filed: Aug. 26, 2005

(65) Prior Publication Data

US 2006/0225340 A1 Oct. 12, 2006

Related U.S. Application Data

(60) Provisional application No. 60/605,992, filed on Aug. 30, 2004.

(51) Int. Cl.
*C10L 1/18* (2006.01)

(52) U.S. Cl. ..... 44/426; 44/412; 44/429

(58) Field of Classification Search ..... 44/301, 44/307, 359, 412, 426, 429
See application file for complete search history.

(56) References Cited

U.S. PATENT DOCUMENTS

| | | | | | |
|---|---|---|---|---|---|
| 4,737,159 | A * | 4/1988 | Phillips | ..... | 44/334 |
| 5,470,358 | A | 11/1995 | Gaughan | ..... | 44/426 |
| 5,536,280 | A * | 7/1996 | DeRosa et al. | ..... | 44/426 |
| 5,851,241 | A | 12/1998 | Studzinski et al. | ..... | 44/359 |
| 6,258,134 | B1 | 7/2001 | Studzinski et al. | ..... | 44/359 |

OTHER PUBLICATIONS

Brown, J.E., Markley, F.X., and Shapiro, H. (1955). "Mechanism of Aromatic Amine Antiknock Action." Industrial and Engineering Chemistry, 47(10), p. 2141-2146.*

Kelly, R.L. (1944). "The Low Temperature Solubility of 24 Aromatic Amines in Aviation Gasoline." NACA Wartime Report (Memorandum Report E4K17). 11 pp.*

Atkins, P.W. (1994) Physical Chemistry, 5th ed. New York: W.H. Freeman & Co.*

Hochhauser, A.M. (1994) "Gasoline and other motor fuels," in Kirk-Othmer Encyclopedia of Chemical Techology, 4th ed., vol. 12, 341-388.*

Kelly, R.L., 1945, The Low Temperature Solubility of 42 Aromatic Amines in Aviation Gasoline, National Advisory Committee for Aeronautics MR No. E5K09.*

* cited by examiner

*Primary Examiner*—Robert J Hill, Jr.
*Assistant Examiner*—Brian McCaig
(74) *Attorney, Agent, or Firm*—Estelle C. Bakun

(57) ABSTRACT

A method is disclosed for reducing the freezing point of unleaded aminated aviation gasoline to −58° C. or lower by the addition of tert-amylphenylamine.

8 Claims, 3 Drawing Sheets

METHOD FOR REDUCING THE FREEZING POINT OF AMINATED AVIATION GASOLINE BY THE USE OF TERTIARYAMYLPHENYLAMINE

This application claims the benefit of U.S. Ser. No. 60/605,992 filed Aug. 30, 2004.

BACKGROUND OF THE INVENTION

1. Field of the Invention

The present invention relates to unleaded aviation gasoline of high motor octane number, low deposit formation, non-fouling and a freezing point of −58° C. or lower, to an additive concentrate and to the method for producing the additive concentrate.

2. Description of the Related Art

The high octane requirements of aviation gas for use in piston driven aircraft which operate under severe requirements, e.g., aircraft containing turbo-charged piston engines, require that commercial aviation fuels contain a high performance octane booster. The organic octane boosters for automobile gasolines (Mogas) such as benzene, toluene, xylene, methyl tertiary butyl ether, ethanol, and the like, are not capable by themselves of boosting the motor octane number (MON) to the 98 to $100^+$ MON levels required for aviation gasolines (Avgas). Tetraethyl lead (TEL) is therefore a necessary component in high octane Avgas as an octane booster.

Compositionally, Avgas is different from Mogas. Avgas, because of its higher octane and stability requirements, is typically a blend of isopentane, alkylate, toluene and tetraethyl lead. A typical Avgas base fuel without octane booster such as tetraethyl lead has a MON of 88 or higher, typically 88 to 97. Mogas, which has lower octane requirements, is a blend of many components such as butane, virgin and rerun naphtha, light, intermediate and heavy cat naphthas, reformate, isomerate, hydrocrackate, alkylate and ethers, or alcohols. Octane requirements of Mogas are based on research octane numbers (RON). For a given fuel, the RON is on average 10 octane numbers higher than its corresponding MON. Thus, the average premium Mogas possesses a MON of 86 to 88, whereas current Avgas must have a MON of 99.5. MON, not RON, is the accepted measure of octane for Avgas and is measured using ASTM D2700-92.

Conventional octane booster for Mogas, such as benzene, toluene, xylene, methyl tertiary butyl ether and ethanol are capable of boosting the MON of unleaded Avgas to the 92 to 95 MON range if added to Avgas in high enough concentrations. As noted previously, this is insufficient to meet the needs of 98 MON high octane Avgas.

With the phasing out of tetra-ethyl lead as an octane booster resort must be made to other means for boosting octane.

U.S. Pat. No. 5,470,358 teaches a high octane unleaded aviation gasoline comprising unleaded aviation gasoline base fuel having a motor octane number of 90-93 and an amount of at least one aromatic amine effective to boost the motor octane number of the base fuel to at least about 98, the aromatic amine having the formula

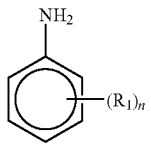

wherein $R_1$ is $C_1$-$C_{10}$ alkyl, n is an integer of from zero to 3 with the proviso that $R_1$ cannot occupy the 2- or 6-position on the aromatic rings.

Alternatively the fuel can comprise the same base fuel and an amount of at least one aromatic amine effective to boost the motor octane number of the base fuel to at least 98, said aromatic amine being a halogen substituted phenylamine or a mixed halogen and $C_1$-$C_{10}$ alkyl substituted phenylamine again with the proviso that the alkyl group cannot occupy the 2- or 6-position on the phenyl ring.

Preferred halogens are Cl or F. When $R_1$ is alkyl, it occupies the 3-, 4-, or 5- (meta or para) positions on the benzene ring. Alkyl groups in the 2- or 6-position result in aromatic amines which cannot boost octane to a MON value of 98. Examples of preferred aromatic amines for octane improvement include phenylamine, 4-tert-butylphenylamine, 3-methylphenylamine, 3-ethylphenylamine, 4-methylphenylamine, 3,5-dimethylphenylamine, 3,4-dimethylphenylamine, 4-isopropylphenylamine, 2-fluorophenylamine, 3-fluorophenylamine, 4-fluorophenylamine, 2-chlorophenylamine, 3-chlorophenylamine and 4-chlorophenylamine. Especially preferred are 3,5-dimethylphenylamine, 3,4-dimethylphenylamine, 2-fluorophenylamine, 4-fluorophenylamine, 3-methylphenylamine, 3-ethylphenylamine, 4-ethylphenylamine, 4-isopropylphenylamine and 4-t-butylphenylamine.

U.S. Pat. No. 5,851,241 and its continuation U.S. Pat. No. 6,258,134 are directed to aviation fuel compositions which contain a combination of an alkyl tertiary butyl ether, an aromatic amine and optionally a manganese component such as methyl cyclopentadenyl manganese tricarbonyl (MMT). The base fuel to which the additive combination may be added may be a wide boiling range alkylate base fuel. According to the patents the combination of the alkyl tertiary butyl ether, the aromatic amine and, optionally, the manganese component result in a synergistic combination while boosts the MON of the fuel to a degree greater than the sum of the MON increases for each additive when used individually in the base fuel.

Heretofore, the aromatic amines which have been investigated, while exhibiting the ability to boost MON of aviation gasoline to 98 and higher have also been found to be susceptible to fouling and deposit formation and/or do not produce a fuel meeting the industry standard for freezing point of −58° C. or lower.

It is desirable to find a way to reduce the freezing point of aviation gasoline preferably unleaded aviation gasoline to −58° C. and lower, avoid deposit formation and be non-fouling in aviation gasoline of reduced toluene content while retaining high MON of at least 98.

DETAILED DESCRIPTION OF THE INVENTION

Figure 1:
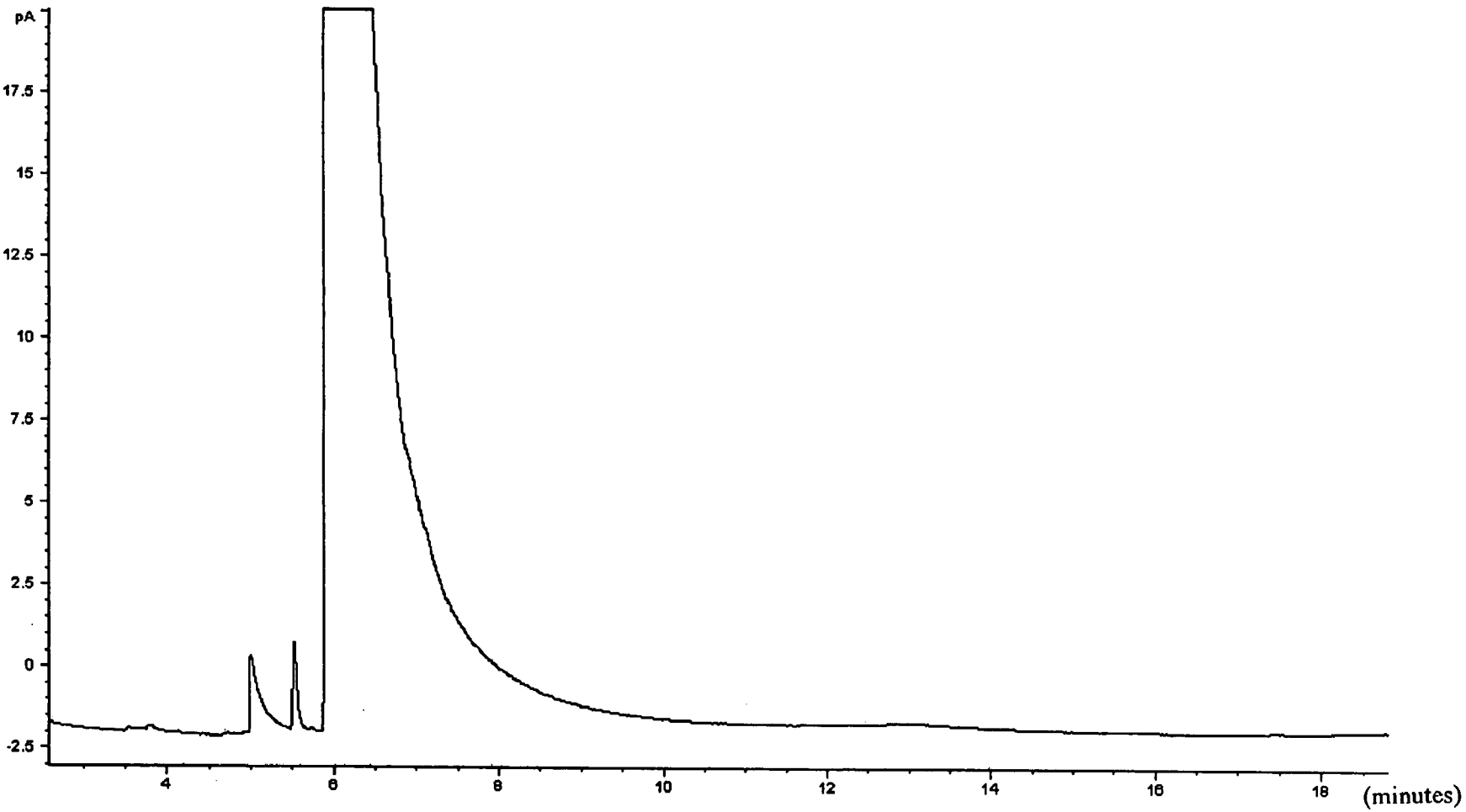
FIG. 1 is a GC-FID trace of about 99.93% pure 4-tert-amylphenylamine.

In accordance with the present invention, a method is provided for producing an aminated aviation gasoline of at least 98 MON, low deposit formation potential/non-fouling and reduced freezing point of at least −58° C. comprising adding to unleaded base aviation gasoline having a MON of at least 88 an effective amount of tert-amylphenylamine. The tert-amylphenylamine (TAPA) employed is meta- and/or para-tertiaryamylphenylamine, which also goes by the name 3- and/or 4- and/or 5-(1,1 dimethylpropyl)phenylamine, CAS #2049-92-5. When used alone in the absence of any other octane booster, the amount of tert-amylpheylamine added to the fuel is an amount sufficient to boost the octane of the aviation gasoline to at least 98 MON. The present invention is also directed to an additive concentrate useful for raising the MON of the aviation gasoline fuel to at least 98, reducing the freezing point of the fuel to at least −58° C. and enabling the fuel to resist deposit formation and be non-fouling comprising the tert-amylphenylamine and at least one additional component selected from a carrier oil such as polypropylene oxide, an antioxidant, a detergent, toluene, and one or more other aromatic amine(s).

An amount of tert-amylphenylamine in the range of about 0.5 to up to about 35 wt %, preferably about 1.0 to about 20 wt % more preferably about 1.0 to about 15 wt % can be used based on the total fuel.

The use of tert-amylphenylamine in unleaded aviation gasoline surprisingly has been found to boost the MON of the fuel, to promote resistance to deposit formation and fouling in the absence of added solvents such as toluene and yield a fuel having a freezing point of −58° C. and lower.

Fuels which freeze at −58° C. or which even exhibit some crystal formation at −58° C. are not considered as having a freezing point of −58° C. or less. The fuel must be substantially free of crystals at −58° C. in order to be considered as meeting the industry standard for aviation gasoline of having a freezing point of −58° C. or lower.

Crystal formation is determined by visual rating as described in ASTM D2386 Standard Test Method for Freezing Point of Aviation Fuels. A cloud forming at approximately −10° C. that does not grow in intensity is due to water and may be disregarded (as per the ASTM D2386 method).

While tert-amylphenylamine can be employed by itself, it can also be employed in combination with other aromatic amines such as those recited in U.S. Pat. No. 5,470,358.

When used in combination with other such aromatic amines which also boost aviation gasoline MON, the tert-amylphenylamine is present in any amount, e.g., at least about 15 mol % of the total of the amines present, preferably at least about 25 mol % of the total of the amines present, more preferably at least about 33 mol % of the total of the amines present, most preferably at least about 50 mol % of the total of the amines present, the tert-amylphenylamine being present in the fuel in the range previously recited, i.e., about 0.5 to up to about 35 wt %, preferably about 1.0 to about 20 wt %, more preferably about 1.0 to 15 wt % based on the total fuel.

In blends where tert-amylphenylamine replaced at least half of the different amine, e.g., t-butylphenylamine, the aminated aviation gasoline fuels containing such mixed amines had freezing points lower than −58° C. and were not supercooled at −58° C. As used herein, the phrase "not supercooled" defines a liquid which upon cooling to a given temperature does not exhibit crystal formation, and upon warming still does not exhibit crystal formation.

Generally the aminated aviation gasoline of the present invention contains anywhere from zero to up to about 25 wt % toluene, but preferably is of very low toluene content, e.g., aminated aviation gasoline fuels containing zero to 6 wt % toluene, more preferably zero to 2 wt % toluene, most preferably zero to ≦1.5 wt % toluene.

Toluene is used as a solvent and when used in high volume helps to reduce fouling and deposit formation in aminated fuel. When toluene is used or present in limited quantity when amines other than tert-amylphenylamine, t-butylphenylamine, or other alkylated phenyl amines with no alpha hydrogen are used, fouling and deposit formation occurs.

Even though some amines other than tert-amylphenylamine have been found to lower the freezing point of aviation gasoline to −58° C. or less, such other amines require the use of substantial quantities of toluene and/or detergent to limit fouling and deposit formation. In fuels which have low toluene and/or detergent content, however, such amines result in measurable fouling and deposit formation.

Surprisingly, it has been found that tert-amylphenylamine not only boosts the MON of base aviation gasoline but also produces an aminated aviation gasoline fuel having a freezing point of −58° C. or less while promoting resistance to fouling and deposit formation in low toluene/detergent content aminated aviation gasoline fuel.

The process of the present invention, therefore, finds particular utility in reducing the freezing point to −58° C. and less of aminated aviation fuels which have very low toluene/detergent content as previously indicated.

Fouling and deposit formation are reduced by employing toluene. Toluene content of about 11 wt % and higher reduce or prevent fouling and deposit formation. In the absence of toluene, however, even isopropylphenylamine, which would produce an aminated aviation fuel having a freezing point of −58° C. or lower, is marked by fouling and deposit formation.

By contrast, tert-amylphenylamine can be used to produce an aminated aviation gasoline fuel having a freezing point of −58° C. and lower, an increased MON and resistance to deposit formation and fouling, the aminated aviation gasoline containing no to very low toluene.

The base aviation gasoline to which the tert-amylphenylamine is added may also contain other additives. Examples of such additional additives include TEL, carrier oils, antioxidants, detergents, toluene and dyes. Cosolvents can also be present and they can include low molecular weight aromatics, alcohols, nitrates, esters, ethers, halogenated hydrocarbons and the like. With the phase out of TEL, other, conventional octane boosters can be present, such as ethers, alcohols, and non-lead metals, including, e.g., ethyl tertiary butyl ether, methyl cyclopentadienyl manganese tricarbonyl, iron pentacarbonyl. Antioxidant content in the fuel can be up to 200 mg/liter of fuel, preferably up to 100 mg/liter of fuel, more preferably up to 50 mg/liter of fuel, most preferably up to 24 mg/liter of fuel. Detergent content in the fuel can be up to 1000 ppm, preferably about 500 ppm, more preferably about 250 ppm, most preferably about 100 ppm. Carrier oil content in the fuel can be up to 500 ppm, preferably up to 250 ppm, more preferably up to 100 ppm, most preferably up to 50 ppm. Approved additives for Avgas are listed in ASTM D-910.

The tert-amylphenylamine can be employed as a concentrate comprising the tert-amylphenylamine and at least one additional additive selected from carrier oil, antioxidant, detergent, toluene and one or more other aromatic amine(s) as taught in U.S. Pat. No. 5,470,358, the amount of any of those additional components in the additive concentrate being such that upon addition of the concentrate to the base fuel in an amount sufficient to achieve a tert-amylphenylamine content in the resulting aminated aviation gasoline fuel of about 0.5 up to 35 wt % based the total aminated aviation gasoline fuel, preferably about 1.0 to about 20 wt %, more preferably about 1.0 to 15 wt % based on total aminated aviation gasoline fuel, the amount of said additional additive in the aminated aviation gasoline fuel is within the ranges recited above for the particular additional additive(s).

4-tert-amylphenylamine can be synthesized by a number of routes, e.g., the selective nitration of the hydrocarbon followed by the reduction to the amine and vacuum distillation, the alkylation of aniline with the appropriate olefin using mild acid catalyst at temperatures of about 200-250° C. followed by vacuum distillation.

The degree of final product purity may depend on the synthesis route taken, routes which lead to the formation of byproducts being those requiring the higher degree of product purification.

Product from the alkylation of aniline can contain alkylated chlorobenzene and/or alkylated nitro benzene and oxidation products as byproducts, while product from the nitration of alkyl aromatic hydrocarbon can contain oxidation products as well as isomers, dimers and diamine as byproducts.

The 4-tert-amylphenylamine used in the following examples was produced by the selective nitration of the alkyl aromatic hydrocarbon followed by reduction to the amine and vacuum distillation. Following the distillation the recovered product had a measured purity of about 99.23% and about 99.29% for 2 assays. This product when added to base fuel was of sufficient purity to give good deposits, fouling and freezing point test results but gave poor results in gum testing (ASTM D-873). When the product was redistilled under vacuum to a measured level of about 99.90% purity (one assay) the fuel to which it was added it still gave poor results in gum testing (ASTM D-873) but when distilled under vacuum to a measured level of about 99.93% purity the fuel to which it was added gave good gum test results (i.e., low gum formation). The degree of purity of the preferred 4-tert-amylphenylamine for use in the present invention can be determined by Gas Chromatographic analysis (GC) as typically practiced by those skilled in the art.

The GC apparatus and procedure employed in generating the figures presented herein are as follows: Instrument: Agilent 6890; Column: SGE HT-5 SIMD 0.1 μm 6 m×0.53 mm; Carrier gas: helium; flow rate: 8.4 ml/min; Inlet Temperature: 430° C. (no-split); Oven: Initial temperature: 30° C.; Initial Time: 0.0 min; Rate: 10° C./min; Final Temperature: 430° C.; Final Time: 19 minutes; Detector: FID; Detector Temperature: 430° C.

Figure 2:
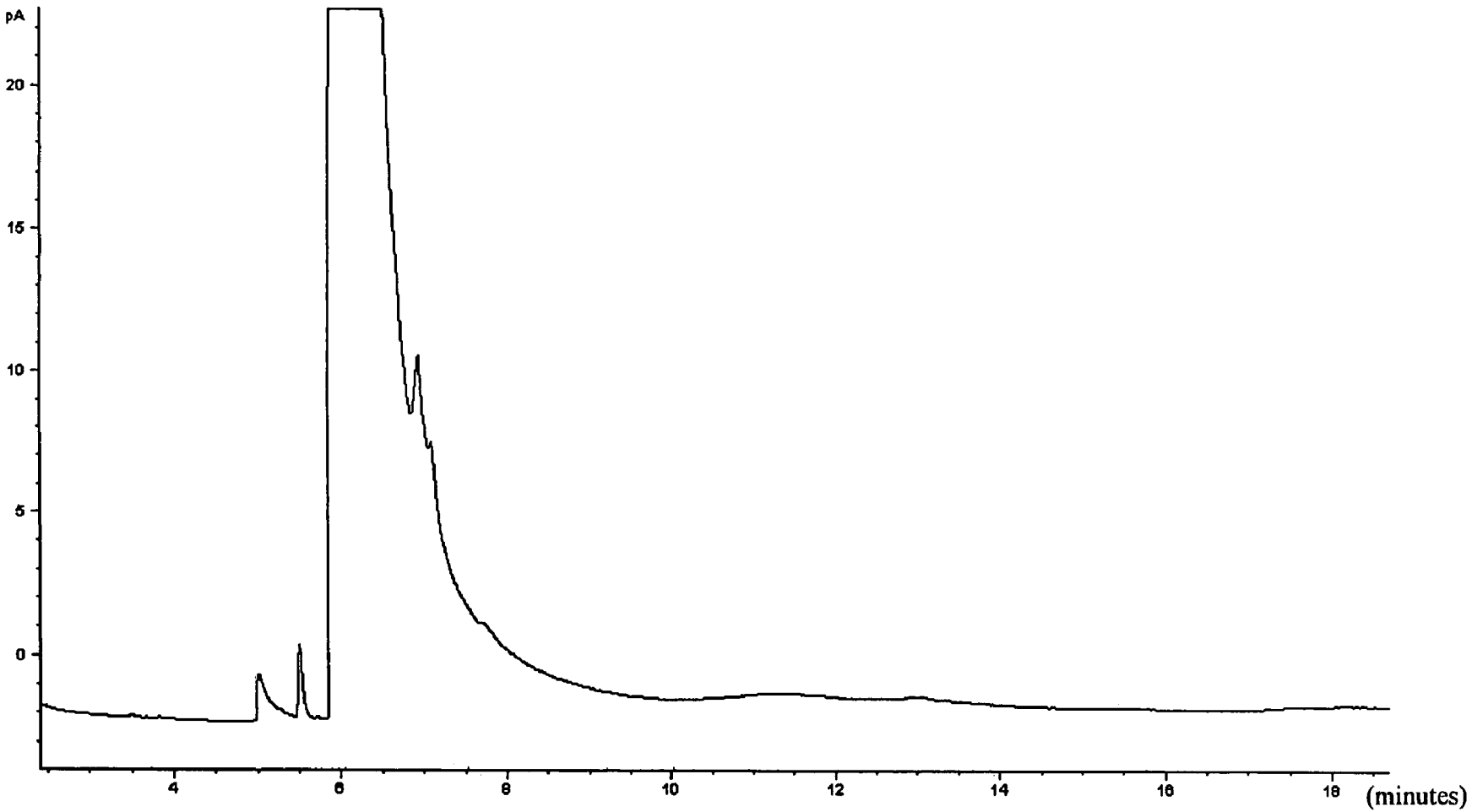
FIG. 2 is a GC-FID trace of about 99.90% pure 4-tert-amylphenylamine.
Figure 3:
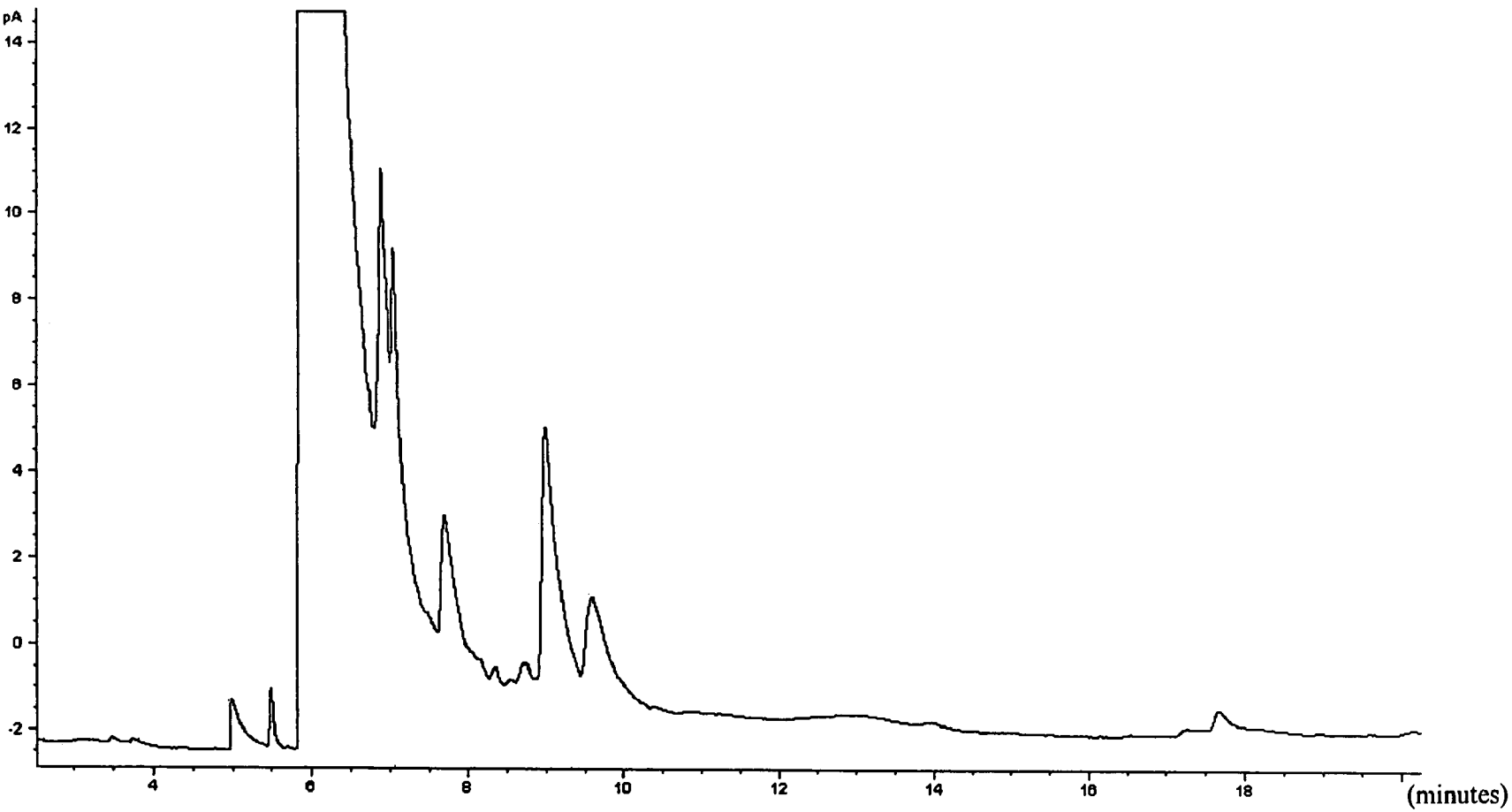
FIG. 3 is a GC-FID trace of about 99.29% pure 4-tert-amylphenylamine.

When subjected to such analysis, the preferred 4-tert-amylphenylamine will produce a GC-FID trace substantially that of FIG. 1. Compare FIG. 1 the GC-FID trace for the about 99.93% pure 4-tert-amylphenylamine with FIGS. 2 and 3. FIGS. 2 and 3 are the GC traces for the about 99.90% pure and the about 99.29% pure 4-tert-amylphenylamine respectively. As previously stated, the materials of FIGS. 2 and 3 gave poor gum test results. The closeness of the percent purity assays, however, indicate that reliance merely on percent purity may not be sufficient to identify the preferred material. It is believed that resort to the GC-FID trace is a better measure of the preferred material purity in the present case than percent purity.

EXAMPLES

Example 1

This example illustrates the effect on freezing point of the addition of different alkylphenylamines to alkylate aviation fuel.

| Blends in weight % | | | Freeze |
|---|---|---|---|
| Alkylate | Alkylphenylamine | Toluene | Point in ° C. |
| 89 | 11 4-TBPA | 0 | −52 |
| 88 | 11 4-TBPA | 1 | −56 |
| 82 | 11 4-TBPA | 6 | pass* |

-continued

| Blends in weight % | | | Freeze |
|---|---|---|---|
| Alkylate | Alkylphenylamine | Toluene | Point in ° C. |
| 90 | 0 4-TBPA<br>10 4-IPPA | 0 | pass** |
| 89.5 | 5.5 4-TBPA<br>5 4-IPPA | 0 | pass** |
| 95 | 5 4-TAPA | 0 | <−70 |
| 80 | 20 4-TAPA | 0 | <−70 |

*froze upon removal from cold bath at −59° C. (supercooled)
**a few crystals formed on top of the sample upon warming Pass = −58° C.
4-TBPA 4-tertiarybutylphenylamine
4-IPPA 4-isopropylphenylamine
4-TAPA 4-tert-amylphenylamine (material of FIG. 3)

Example 2

This example illustrates the effect on fouling and deposit formation of the addition of 4-t-butyl-, 4-isopropyl-, and 4-tert-amyl-phenylamines to alkylate fuels. The test was run in accordance with the procedure reported in U.S. Pat. No. 5,492,005. In the test n-heptane insolubles and toluene insolubles were measured and the fouling potential determined. In the test a metal nub is cycled between 150° C. and 300° C. in 9 minute cycles. About 40 ml of fuel is dripped on the nub in an air atmosphere. The nub is weighed before and after feed is dripped on it to five decimal places (0.00001 g). It is then washed with n-heptane and weighed and with toluene and weighed to determine the n-heptane and toluene insolubles.

| Feed to Deposit test (all as wt %) | n-Heptane insoluble deposit (mg) | Toluene insoluble deposit (mg) | Fouling Potential* |
|---|---|---|---|
| alkylate | 0 | 0 | Non-fouling |
| alkylate + 11% 4-TBPA | 0.08 | 0.08 | Mildly fouling |
| alkylate + 11% 4-TBPA + 11% toluene | 0.01 | 0.02 | Non-fouling |
| alkylate + 11% 4-IPPA | 0.14 | 0.14 | Low-Moderate fouling |
| alkylate + 11% + 4-IPPA 11% toluene | 0.08 | 0.03 | Non-fouling |
| alkylate + 12% 4-TAPA (2 tests) | 0.00 (0.04) | 0.00 (0.03) | Non-fouling |

*non-fouling is given as 0.03 mg or less deposit of toluene insolubles
4-TBPA 4-tertbutylphenylamine
4-IPPA 4-isopropylphenylamine
4-TAPA 4-tert-amylphenylamine (material of FIG. 3)

Example 3

This example illustrates the effect on freezing point of the addition of 4-tertamylphenylamine (99.29% purity, FIG. 3) and 4-t-butylphenylamine in different molar ratios to alkylate aviation fuel, at different cooling temperatures. A total of between 11 wt % to about 12 wt % amine was added to the alkylate then cooled either at −58° C. or −70° C. then warmed to room temperature.

| Cooled at −58° C. | | | | | | |
|---|---|---|---|---|---|---|
| % of Amines (molar) | | Concentration (wt %) | | Lowest Temperature | On Warming | |
| 4-TAPA | 4-TBPA | 4-TAPA | 4-TBPA | Reached (° C.) | Crystals Appeared, ° C. | Crystals Disappeared, ° C. |
| 50 | 50 | 6 | 5.5 | −58 | n/a | n/a |
| 25 | 75 | 3 | 8.2 | −58 | −54.5 | −25 |
| 33 | 67 | 4 | 7.3 | −58 | −56.5 | −24.5 |
| 9 | 91 | 1.1 | 10 | −41.5 | −41.5 | −20.5 |
| 0 | 100 | 0 | 11 | −45 | −45 | −19.5 |
| 67 | 33 | 8 | 3.6 | −58 | n/a | n/a |
| 75 | 25 | 9 | 2.8 | −58 | n/a | n/a |
| 90 | 10 | 10.8 | 1.1 | −58 | n/a | n/a |

| Cooled at −70° C. | | | | | | |
|---|---|---|---|---|---|---|
| % of Amines (molar) | | Concentration (wt %) | | Lowest Temperature | On Warming | |
| 4-TAPA | 4-TBPA | 4-TAPA | 4-TBPA | Reached (° C.) | T Crystals Appeared, ° C. | T Crystals Disappeared, ° C. |
| 50 | 50 | 6 | 5.5 | −67.5 | −67.5 | −28 |
| 25 | 75 | 3 | 8.2 | −69 | −69 | −24.5 |
| 33 | 67 | 4 | 7.3 | −70 | −2.5 | −2.5 |
| 9 | 91 | 1.1 | 10 | −62.5 | −62.5 | −21.5 |
| 0 | 100 | 0 | 11 | −58 | −58 | −16.5 |
| 5 | 95 | 0.6 | 10.4 | −55.5 | −55.5 | −17 |
| 67 | 33 | 8 | 3.6 | −70 | n/a | n/a |
| 75 | 25 | 9 | 2.8 | −70 | −50 | −2.5 |
| 90 | 10 | 10.8 | 1.1 | −70 | n/a | n/a |
| 0 | 100 | 0 | 11 | −47.5 | −47.5 | −20.5 |

Example 4

This example illustrates the effect on the gum formation capacity of aviation fuel containing 4-tert-amylphenylamines of different purities.

Each sample is a blend of 12 wt % 4-tert-amylphenylamine and 88 wt % alkylate. These blends were tested using the 16 hour version of ASTM D873.

| Purity of amine in 12 wt % TAPA/88 wt % alkylate blend | ASTM D873 16 hours Potential Gum (mg/100 mL) | Relative Gum Amount |
|---|---|---|
| 99.29* | 38.8 | High |
| 99.90** | 24.5 | High |
| 99.90** | 22.1 | High |
| 99.93*** | 6.4 | Moderate |
| 99.93*** | 7.4 | Moderate |

*corresponds to FIG. 3
**corresponds to FIG. 2
***corresponds to FIG. 1

What is claimed is:

1. A method for producing an aminated unleaded aviation gasoline comprising adding to base unleaded aviation gasoline having a base MON of at least about 88, at least 5 wt % of a meta- and/or para-tert-amylphenylamine based on the total aminated aviation gasoline wherein said aminated unleaded aviation gasoline containing the meta- and/or para-tert-amylphenylamine has a MON of at least 98, a low deposit formation potential evidenced by toluene insoluble deposits of from 0.00 to 0.03 mg measured by a test in which a metal nub is cycled between 150° C. and 300° C. in 9 minute cycles while about 40 ml of the aminated unleaded aviation gasoline is dripped on the nub in an air atmosphere, the nub weighed to five decimal places (0.00001 g) before and after the aminated unleaded aviation gasoline is dripped onto it, the nub then being washed with n-heptane and weighed and with toluene and weighed to determine the toluene insoluble deposits, and the freezing point of the aminated unleaded aviation gasoline is −58° C. or lower and wherein the aminated aviation gasoline contains from zero to about 2 wt % toluene.

2. The method of claim 1 wherein the aminated aviation gasoline contains from zero to ≦1.5 wt % of toluene.

3. The method of claim 1 or 2 wherein the amount of tert-amylphenylamine added to the base aviation gasoline is in the range of at least 5.0 to about 20 wt % based on the total aminated aviation gasoline.

4. The method of claim 1 or 2 wherein the amount of tert-amylphenylamine added to the base aviation gasoline is in the range at least 5.0 to about 15 wt % based on the total aminated aviation gasoline.

5. The method of claim 1 or 2 wherein the aminated aviation gasoline contains one or more other alkyl phenyl amine octane boosters in addition to and different from the tert-amylphenylamine, wherein the tert-amylphenylamine constitutes at least about 15 mol % of the total of the amines present, wherein the alkyl phenyl amine different from the tert-amylphenylamine has the formula:

$$NH_2—Ar(R_1)_n$$

wherein $R_1$ is selected from the group consisting of $C_1$-$C_{10}$ alkyl, halogen and mixture thereof, Ar is a phenylene aromatic group, n is an integer from zero to 3 and wherein when n is 1 or 2 and when $R_1$ is alkyl it is in the meta- and/or para-position.

6. The method of claim 5 wherein the aminated aviation gasoline contains one or more other alkylphenylamine octane boosters in addition to the tert-amylphenylamine and wherein the tert-amylphenylamine constitutes at least about 15 mol % of the total of the amines present.

7. The method of claim 5 wherein the aminated aviation gasoline contains one or more other alkylphenylamine octane boosters in addition to the tert-amylphenylamine and wherein the tert-amylphenylamine constitutes at least about 25 mol % of the total amines present.

8. The method of claim 5 wherein the aminated aviation gasoline contains one or more other alkylphenylamine octane boosters in addition to the tert-amylphenylamine and wherein the tert-amylphenylamine constitutes at least about 50 mol % of the total of the amines present.

* * * * *